US007481249B2

(12) United States Patent
Krumm et al.

(10) Patent No.: US 7,481,249 B2
(45) Date of Patent: Jan. 27, 2009

(54) REED DRIVE OF A LOOM

(75) Inventors: Valentin Krumm, Hergensweiler (DE); Dietmar Von Zwehl, Achberg (DE); Michael Lehmann, Kressbronn (DE); Thomas Laukamp, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 11/663,693

(22) PCT Filed: Aug. 26, 2005

(86) PCT No.: PCT/DE2005/001499

§ 371 (c)(1),
(2), (4) Date: Mar. 22, 2007

(87) PCT Pub. No.: WO2006/032233

PCT Pub. Date: Mar. 30, 2006

(65) Prior Publication Data

US 2008/0099095 A1 May 1, 2008

(30) Foreign Application Priority Data

Sep. 25, 2004 (DE) ..... 10 2004 046 649

(51) Int. Cl.
*D03D 49/06* (2006.01)
*D03D 49/60* (2006.01)
*D03D 51/02* (2006.01)
*D03D 13/00* (2006.01)

(52) U.S. Cl. ..... 139/80; 139/84; 139/99; 139/1 E; 139/190; 139/192

(58) Field of Classification Search ..... None
See application file for complete search history.

(56) References Cited

U.S. PATENT DOCUMENTS 4,143,684 A * 3/1979 Lindenmuller et al. ..... 139/450
4,878,392 A * 11/1989 Jaeger et al. ..... 74/333
5,058,628 A 10/1991 Spiller et al.
5,253,681 A * 10/1993 Cramer et al. ..... 139/192
5,499,662 A 3/1996 Vogel et al.
5,797,433 A 8/1998 Matas Gabalda (Continued)

FOREIGN PATENT DOCUMENTS

DE 198 21 094 7/1999

(Continued)

*Primary Examiner*—Bobby H Muromoto, Jr.
(74) *Attorney, Agent, or Firm*—W. F. Fasse; W. G. Fasse

(57) ABSTRACT

A reed drive of a loom includes a reed shaft connected to a reed. A conversion gearing having an input element and an output element is provided at each end of the reed shaft. The input elements are coupled to driven shafts of electromotive rotary drives to produce a common rotational motion with the same rotational speed as the driven shafts. The conversion gearings convert the rotating motion of their input elements into a reversible rotation of the output elements, and the output elements are coupled to the reed shaft in a rotationally fixed manner. Thus, the number of complete rotations of an input element is equal to the number of complete motion cycles of the reed shaft per unit of time.

23 Claims, 7 Drawing Sheets

U.S. PATENT DOCUMENTS

| | | | | |
|---|---|---|---|---|
| 6,065,503 | A | 5/2000 | Berktold et al. | |
| 6,230,758 | B1 * | 5/2001 | Krumm et al. | 139/188 R |
| 6,307,340 | B1 * | 10/2001 | Wagner et al. | 318/431 |
| 6,418,972 | B2 * | 7/2002 | Krumm et al. | 139/188 R |
| 6,913,044 | B2 * | 7/2005 | Zwehl et al. | 139/1 E |
| 6,962,171 | B2 * | 11/2005 | Krumm et al. | 139/116.2 |
| 2001/0015235 | A1 * | 8/2001 | Dornier et al. | 139/50 |
| 2001/0042570 | A1 * | 11/2001 | Krumm et al. | 139/188 R |
| 2003/0084951 | A1 * | 5/2003 | Zwehl et al. | 139/11 |
| 2004/0025956 | A1 * | 2/2004 | Krumm et al. | 139/11 |
| 2005/0016611 | A1 * | 1/2005 | Casrotto | 139/1 E |
| 2005/0178457 | A1 * | 8/2005 | Von Zwehl et al. | 139/55.1 |

FOREIGN PATENT DOCUMENTS

| | | | |
|---|---|---|---|
| EP | 0 440 579 | | 8/1991 |
| EP | 0 796 360 | | 9/1997 |
| EP | 0 892 100 | | 1/1999 |
| EP | 1 312 709 | | 5/2003 |
| JP | 2001355152 | A * | 12/2001 |
| JP | 2003193354 | A * | 7/2003 |

* cited by examiner

REED DRIVE OF A LOOM

TITLE OF THE INVENTION

FIELD OF THE INVENTION

The invention relates to a reed drive of a loom, with a reed mounted on a reed shaft and with conversion gears, by means of which the rotational movement of one or more electromotive rotary drives is converted into a reciprocating pivoting movement of the reed.

BACKGROUND INFORMATION

In the prior art, proposals have for some considerable time been noted to replace the central drive of looms by means of a single drive motor by a plurality of individual drives, each of which is drive-active in a very specific part region of the loom. So that these individual electromotive rotary drives cooperate appropriately during the weaving operation, synchronizing devices in the manner of electric shafts are required and are known. The invention is concerned particularly with the individual drive of the reed.

Examples of this may be gathered from EP 796 360 B1 and EP 1 312 709 A1. According to EP 796 360 B1, the reed has mounted on or connected to it a reed shaft which is set in a reciprocating pivoting movement via two gears located at its ends. Said gears are located outside the reed width and have input shafts which are set in rotation via reduction gears by electromotive rotary drives located still further outside. The input shafts of the gears thus rotate at a speed other than that of the output shafts of the electromotive rotary drives. Further, it is also assumed that the gears acting on the reed shaft serve not only as conversion gears for achieving a reciprocating pivoting movement of the reed shaft, but, furthermore, also as additional reduction gears. This is customary in the prior art. Moreover, the drive for gripper mechanisms serving for the insertion of the weft threads is derived via rotating cam disks from the input shafts of the gears located outside the reed width. The two electromotive rotary drives of the reed drive are driven in parallel by one or two frequency converters. Synchronization is additionally provided, for which may also serve a connecting shaft which runs at a distance from and parallel to the reed shaft and which runs coaxially with the input shafts of the gears.

In the reed drive of EP 1 312 709 A1, a drive shaft consisting of two parts is provided, which is arranged so as to run parallel to the reed shaft. The electro-motive rotary drive of the reed is arranged in the middle of the two part shafts and also in the middle of the reed-width longitudinal center of symmetry of the loom. Said electromotive rotary drive has at its ends two output shafts which are connected to the part shafts of the drive shaft. At the outer ends of the two part shafts are located cam disks which serve as conversion gears and convert the rotational movement of the electromotive rotary drive into a reciprocating movement of the reed shaft. In EP 1 312 709 A1, particular reference is made to the advantage to be afforded by the symmetrical design of the drive with the arrangement of the electromotive rotary drive in the plane of symmetry of the loom running in the longitudinal direction. It is in this case considered particularly important that the torsion of two part shafts is, overall, lower than the torsion of a continuous overall shaft of double the length of a part shaft. It is also already pointed out that the torsional and flexural stress on the drive shaft presents a problem, as do inertia forces and the risk of vibration problems. In this context, it is proposed to arrange the single electromotive rotary drive in a "barycentric" position, in which the stress due to inertia forces is to be the lowest. However, this barycentric arrangement is likewise to be adapted to the arrangement in the longitudinal center of the loom which is considered the greatest advantage and the actual feature of the solution of this known reed drive.

SUMMARY OF THE INVENTION

The aim of the invention is to develop further the reed drives according to the prior art and to provide a low-inertia dynamic drive with reduced energy requirement, which, overall, ensures a rigid construction and, moreover, a further decoupling of disturbance variables.

A first inventive implementation of this aim is achieved in a reed drive of a loom, with a reed shaft mounted on a reed, with at least in each case one conversion gear which is located in the respective outward-facing region of the reed shaft and which has a movable input member and a movable output member, the output member of each conversion gear being connected fixedly in terms of rotation to that region of the reed shaft which is assigned to it, with a design of the conversion gears such that in each case the rotational movement of the input member is converted into a movement of reversible direction of rotation of the output member, and with at least one electromotive rotary drive for the input member of each conversion gear, the electromotive rotary drive causing a rotational movement of its output shaft in common with and at the same rotational speed as the input member.

In the reed drive according to the invention, "respective outward-facing region of the reed shaft" means that this may extend from the outer ends of the reed shaft, which coincide essentially with the outer ends of the reed, inward approximately up to 30% of the reed shaft length. It therefore not only refers to such extreme end regions as occur in the prior art. In this case, even more than one conversion gear may be located in each of these outward-facing regions.

During operation, the movable input member of each conversion gear is to execute a rotational movement while the associated output member is executing a reciprocating pivoting movement. In this case, the movement cycle of an input member is to correspond to the movement of the output member and consequently also of the reed from one reed beat-up to the next following reed beat-up, so that the number of complete revolutions of an input member is equal to the number of complete movement cycles which the reed shaft executes in the same unit of time. The design of the input members and output members may vary. In addition to a simple wavy shape, it is also possible to have a configuration as a hollow shaft, into which the output shaft of an electromotive rotary drive or the reed shaft is plugged in a coupling manner with the aid of a toothing. However, gearwheels could also be relevant, with a central rotationally symmetrical cavity which receives an external shaft by means of a press fit.

In the simplest instance, and for economic reasons, each conversion gear on the input side is assigned only a single electromotive rotary drive. Basically, however, it is also possible, for example, to cause two motors to act on a conversion gear, this being advantageous particularly during the warm-up of the machine and being implementable at acceptable outlay by means of a hollow shaft design.

Where it is stipulated for the reed drive according to the invention that the electromotive rotary drive is to bring about a rotational movement of its output shaft in common with and at the same rotational speed as the input member, this means that, at each time point, the angular position and the rotational speed of the output shaft and input member are identical. A direct connection and transmission in the ratio 1:1 are thus achieved. If the overall drive train from the electro-motive rotary drive, including the conversion gear, up to the reed shaft is considered, it can also be stated, as regards the drive train, that the number of complete revolutions of the output shaft of the electromotive rotary drive per unit of time is equal to the number of complete movement cycles which the reed shaft executes in the same unit of time. There is therefore no step-up or step-down. In the reed drive according to the invention, the selection of the electromotive rotary drives assumes considerable importance. It is important to make available electric motors which, while having a sufficiently high rotational speed, also generate a sufficiently high torque, can be controlled and regulated accurately and operate reliably in continuous operation. However, motors of this type can be procured in the meantime. A reed drive is then obtained, in which the rotational masses are reduced decisively, and which therefore can operate dynamically and be operated and controlled at an increased speed. The energy consumption is in this case reduced, although, overall, a rigid construction can be achieved and the number of disturbance variables is reduced.

In an advantageous development of the reed drive according to the invention, the reed shaft consists of two part shafts which are in alignment with one another and the inner ends of which face one another.

In this refinement, the possibility of reducing the torsional stress on the reed shaft is afforded, while at the same time the vibration behavior can be improved and the weaving speed increased. In this refinement, the movable parts of the at least two drive trains, consisting of the electromotive rotary drive, conversion gear and part shaft of the reed shaft, still remain connected to one another mechanically via the reed and the conventional reed batten.

However, according to further refinements, it is basically also possible, in a reed with a reed batten, to design the latter in the form of two part battens which are in alignment with one another and are structurally separate from one another and each of which is connected to one of the part shafts, or even to design the reed in the form of two structurally separate part reeds lying in a common plane. In this case, however, this involves a considerable outlay in terms of synchronization between the two drive trains.

Despite the structural separation, the part shafts, part battens and part reeds may, however, remain in a functional relationship.

Thus, a further refinement is provided, in which the mutually facing inner ends of the two part shafts stand opposite one another with the possibility of mutual rotatability. They may in this case, for example, be supported with respect to one another, with the result that at least the risk of flexion is reduced. The construction thereby becomes more rigid overall.

This applies particularly when the mutually facing inner ends of the part shafts engage positively and rotatably one in the other.

In a development of the possibilities indicated as a result, in the reed drive according to the invention the mutually facing inner ends of the part shafts are connected to one another via a predetermined weakening region which is separated when a predetermined limit torque is overshot.

In this advantageous refinement, the two part shafts move in phase as a common unit. It may happen, however, that the torsional stress on the reed shaft becomes inadmissibly high during operation, for example in the event of a failure of one of the drive trains. In this case, the part shafts are separated from one another in due time in the predetermined weakening region. The destruction of even further parts of the loom is thereby avoided.

According to a further advantageous refinement, predetermined weakening regions of this type may also be arranged between the part battens of the reed batten and/or the part reeds of the reed, so that, even in the event of excessive stress on the reed batten and reed, the remaining machine parts are protected against destruction.

Instead of a predetermined weakening region, it is also possible to connect the mutually facing inner ends of the part shafts to one another via a torque limitation coupling. In the event of an excessive torsional moment on the reed shaft, the torque limitation coupling is disengaged, with the result that damage to the part shafts is avoided. In this case, further signal or switching devices may be linked to the disengagement of the torque limitation coupling, so that a rapid switch-off of the loom in an emergency is ensured.

A corresponding sliding and deflection region of a function comparable to that of a torque limitation coupling may also be present in the region of the reed. Thus, in the event of excessive transverse stress, the two part reeds of the reed can be decoupled from one another nondestructively.

In many instances, it will be expedient to place the arrangement point, at which the mutually facing inner ends of the part shafts stand opposite one another, into the geometric longitudinal center of the entire reed shaft consisting of the two part shafts. This then also applies correspondingly to the reed and the reed batten and to the arrangement of predetermined weakening points, of a torque limitation coupling and of corresponding designs for the reed and the reed batten.

However, during operation, the units consisting of the part shafts, the part battens and the part reeds are in no way loaded symmetrically, that is to say in the same way. If, for example, the loom is an airjet loom, then part of the weft thread insertion system is arranged laterally next to the reed. This region therefore has a higher rotational mass, which is manifested as increased torsional and transverse stress during operation. According to a particularly advantageous refinement, therefore, there is provision for the arrangement point of the mutually facing inner ends of the part shafts and, if appropriate, also of the part battens and part reeds to be defined according to the region of lowest torsional and/or transverse stress of a theoretically assumed continuous unit consisting of a reed shaft, reed and reed batten. Torsion and transverse forces are thereby kept low from the outset in the most reliable possible way. Should a mutual deformation or even separation of the two parts of reed shaft, reed batten and reed nevertheless be required, the extent of the mutual movement or separating movement will thereby remain low.

In many practical instances, the last-mentioned refinement comes down to the fact that the arrangement point of the mutually facing inner ends of the part shafts and, if appropriate, also of the part battens and part reeds is located within a middle third of the length of the theoretically assumed continuous reed shaft.

A further embodiment also corresponds to this whereby the arrangement point of one or more conversion gears on its associated part shaft is shifted inward from its outer end as far as one third of the part shaft length.

The required synchronization of the at least two drive trains which are present in the reed drive according to the invention is advantageously achieved by means of an electronic synchronism regulation of the electromotive rotary drives in a master/slave arrangement.

In this case, the first of two electromotive rotary drives is regulated according to the desired value given by an external source and transfers the actual value of the first electromotive rotary drive, occurring in this case, as a desired value to the second of the two electromotive rotary drives.

A modification of this electronic synchronism regulation consists of a master/slave arrangement with a common master which is preferably designed as a virtual master.

A second inventive implementation of the aim initially mentioned above is achieved in a reed drive of a loom, with a reed shaft mounted on a reed, with two conversion gears which are located in the outer regions of the reed shaft and each of which has a movable input member and a movable output member, the rotational movement of the input members being converted by the conversion gears into a movement of reversible direction of rotation of the output members which are connected fixedly in terms of rotation to the reed shaft, with a connecting shaft which is arranged parallel to the reed shaft between the conversion gears and is connected fixedly in terms of rotation to the input members of the latter, and with at least one electromotive rotary drive of at least one of the input members, which is located on that side of this input member opposite the connecting shaft and which causes a rotational movement of its output shaft in common with and at the same rotational speed as the input member.

In contrast to the first inventive implementation mentioned initially, in the second inventive reed drive there is a connecting shaft which forms with the input members of the conversion gears a rotationally fixed unit. In this case, a drive with only one electromotive rotary drive arranged outside the reed width is advantageous, because the connecting shaft transmits the drive power to the second opposite conversion gear. However, an electromotive rotary drive may also be provided on each of the two conversion gears outside the reed width, the connecting shaft serving for equalizing the transmitted torque and also acting in a synchronizing way. As regards the understanding of individual terms used in the present context, such as conversion gear, outer region, input member and output member, and the understanding of the common rotational movement of the same rotational speed of output shaft and input member, the definitions already given for the first implementation of the invention apply again for this second implementation of the invention.

In the simplest instance, the output member of each conversion gear is formed by a shaft which is then coupled to the reed shaft in a way familiar to a person skilled in the art. It is also possible, however, to design the reed shaft as a common output member of the two conversion gears.

Even if the connecting shaft in the reed drive according to the second inventive implementation acts in a synchronizing way, it is nevertheless expedient to provide additional synchronization measures in the drive with more than one electromotive rotary drive. According to an advantageous refinement, the electro-motive rotary drives are then connected to one another by means of an electronic synchronism regulation in a master/slave arrangement.

Here, too, the special configuration of the master/slave arrangement with a common master which is preferably designed as a virtual master may be provided for this purpose.

BRIEF DESCRIPTION OF THE DRAWINGS

The invention is subsequently explained in more detail by means of exemplary embodiments illustrated in FIGS. 1 to 11. The following is illustrated in the figures.

DETAILED DESCRIPTION OF EXAMPLE EMBODIMENTS OF THE INVENTION

Figure 1:
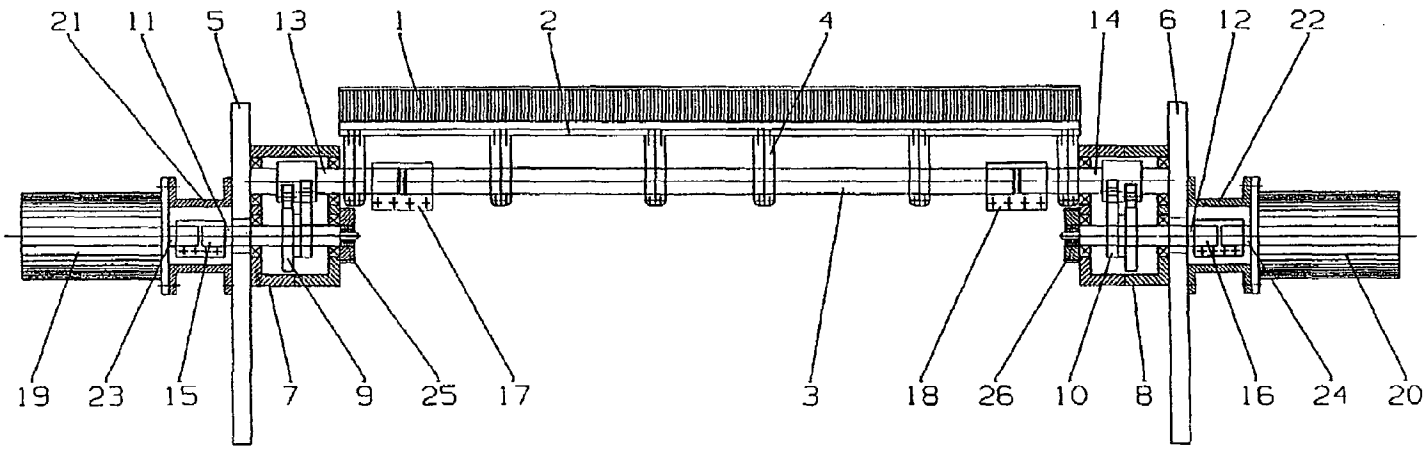
FIG. 1 shows a first exemplary embodiment of the reed drive according to the invention in a partially sectional illustration transversely to the weaving direction.

FIG. 1 illustrates a reed drive according to the invention in a diagrammatic view transversely to the take-off direction of the woven fabric obtained. The reed, which has a reed batten 2, is designated by 1. The reed batten 2 is connected to a reed shaft 3 via fastening arms 4, so that the reed shaft 3 is mounted on or connected to the reed 1 (or vice versa) . In the exemplary embodiment according to FIG. 1, the reed 1 and the reed batten 2 are in each case designed continuously in one part over the entire weaving width. The reed shaft 3, too, is of continuous design and extends almost over the entire weaving width.

The loom, not illustrated any further, has two fixed columns 5 and 6, on which two conversion gears, designated as a whole by 7 and 8, are located. In each conversion gear 7, 8 are located cam disks 9, 10, via which input members 11, 12 of the conversion gears 7, 8 are connected operatively to output members 13, 14 which are likewise arranged in the conversion gears 7, 8. Instead of the cam disks 9, 10, crank mechanisms having the same function could also be provided.

In the exemplary embodiment of FIG. 1, the input members 11, 12 and output members 13, 14 have conventional shafts which are mounted in the housings of the conversion gears 7, 8. The bearings of these shafts are indicated in FIG. 1. The function of the conversion gears 7, 8 is solely to convert the rotational movement of the input members 11, 12 into a movement of reversible direction of rotation of the output members 13, 14. They do not have the function of stepping up or stepping down a rotational speed ratio. The output members 13, 14 of the conversion gears 7, 8 are connected fixedly in terms of rotation to the reed shaft 3 via rigid output couplings 17, 18. The conversion gears 7, 8 have the effect that a movement cycle of an input member 11, 12 corresponds to the movement of the reed 1 from one reed beat-up to the next following reed beat-up, so that the number of complete revolutions of an input member is equal to the number of complete movement cycles which the reed shaft executes in the same unit of time.

Electromotive rotary drives 19, 20, designated briefly below as electric motors, are fastened to the columns 5, 6 of the loom via intermediate flanges 21, 22. The electric motors 19, 20 have output shafts 23, 24 which are connected fixedly in terms of rotation to the input members 11, 12 of the conversion gears 8, 9 via input couplings 15, 16. The input couplings 15, 16 are indicated in FIG. 1 as simple rigid connecting couplings; they have no shift function; the illustration in the drawing is, however, not mandatory. For example, a design as a hollow shaft with a coupling plug-in journal may also be envisaged, or a continuous shaft as a common component of the input member 12, 13 and output shaft 23, 24, insofar as this is expedient. It is critical, above all, that each electric motor 19, 20 causes a rotational movement of its output shaft 23, 24 common with and at the same rotational speed as the input member 12, 13 of the conversion gear 7, 8 assigned to it.

The function, already mentioned, of each conversion gear, even including the electric motors, is thereby maintained; the number of complete revolutions of the output shaft 23, 24 of the electric motor 19, 20 per unit of time is equal to the number of complete movement cycles which the reed shaft executes in the same unit of time. There is therefore no step-up or step-down.

25 and 26 designate in FIG. 1 rotary encoders, by means of which the rotational speed and angular position of the input members 11, 12 can be detected. This serves for the electronic synchronism regulation of the reed drive according to the invention, as is to be explained further below.

For the functioning of the reed drive according to the invention, as shown in FIG. 1, it is essential, as already stated, that the reed 1, the reed batten 2 and the reed shaft 3 are of continuous design. A mechanical coupling of the movable parts of the conversion gears 7, 8 and of the electric motors 19, 20 takes place solely via these three parts.

Figure 2:
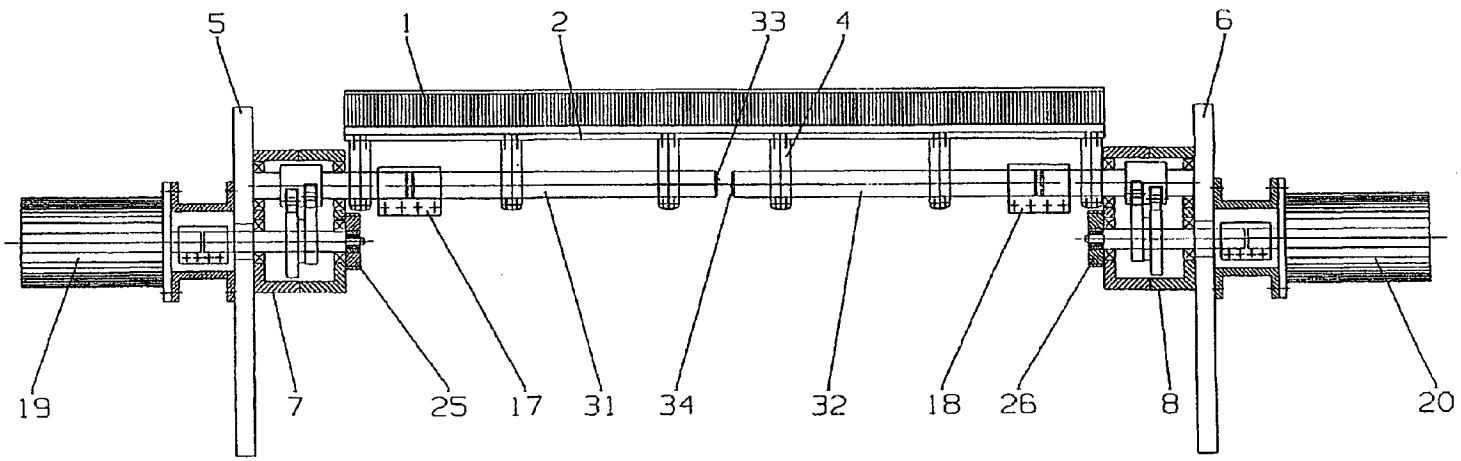
FIG. 2 is an illustration, corresponding to FIG. 1, of an embodiment modified in the region of the reed shaft.

The embodiment, illustrated in FIG. 2, of the reed drive according to the invention largely corresponds to that according to FIG. 1. The most important parts which have remained unchanged are therefore also designated by the same reference numerals as in FIG. 1. The difference from the first embodiment is that, according to FIG. 2, the reed shaft is formed by two part shafts 31, 32. The two part shafts are in alignment with one another, and their inner end faces 33, 34 face one another. As is readily apparent from FIG. 2, there are two drive trains, to be precise a first drive train with the electric motor 19, the conversion gear 7, the output coupling 17 and the part shaft 31 and a second drive train with the electric motor 20, the conversion gear 8, the output coupling 18 and the part shaft 32.

In the embodiment according to FIG. 2, the reed 1 and the reed batten 2 are, as before, of continuous design. There is therefore still a mechanical coupling of the movable parts of the two drive trains via the reed 1 and the reed batten 2.

In the following exemplary embodiments according to FIGS. 3 to 7, too, the basic construction of the reed drive according to the invention, as illustrated in FIGS. 1 and 2, remains unchanged. The changes to be described below occur, above all, in that region in which the two inner end faces 33, 34 of the two part shafts 31, 32, that is to say their mutually facing inner ends, stand opposite one another. FIGS. 3 to 7 therefore in each case show only a detail, with the region mentioned, from an illustration corresponding to FIGS. 1 and 2.

Figure 3:
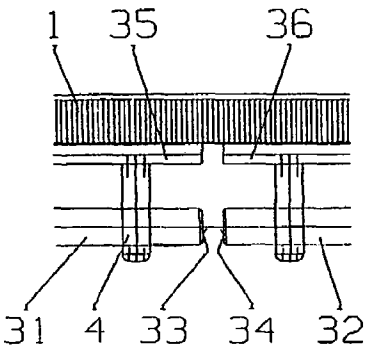
FIG. 3 illustrates a further modification of the embodiment according to FIG. 2.

FIG. 3 shows a version in which the reed batten of the reed 1 also consists of two part battens 35 and 36 which are in alignment with one another and are structurally separate from one another and each of which is connected to one of the part shafts 31, 32. In this case, as before, the two part battens 35, 36 are mounted on the continuous reed 1, that is to say are also connected to this. In the embodiment according to FIG. 3, therefore, the reed 1 forms a mechanical connection for the movable parts of the two drive trains.

Figure 4:
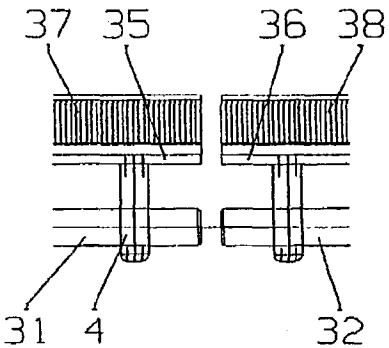
FIG. 4 illustrates an additional variant of the version shown in FIG. 3.

According to FIG. 4, even this last mechanical coupling is eliminated, in that, here, the reed consists of two part reeds 37 and 38. The required synchronism of the two drive trains must take place here solely due to an electronic synchronism regulation of the electric motors 19, 20, which is described further below.

It is a question, in the respective design of the drive, of whether the two drive trains are separated completely from one another mechanically or whether they are coupled to one another as firmly as possible via the reed 1, the reed batten 2 and the reed shaft 3. A slight twisting or torsion of these parts will always occur during operation. This may become hazardous if, for example, one of the drive trains fails during operation or other faults occur. There is then the risk that not only the reed, but the entire reed drive or even further parts are destroyed.

In order to prevent this, intermediate solutions are also possible. According to these, the two part shafts 31, 32, although remaining coupled or connected to one another, nevertheless have the possibility of rotating with respect to one another, if required. Corresponding possibilities are also afforded for the reed and the reed batten.

Figure 5:
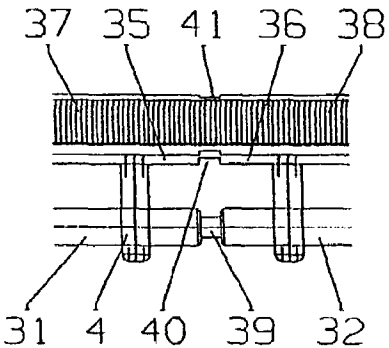
FIG. 5 relates to a modification of the reed drive according to the invention, as shown in FIG. 2, in the region of the part shafts.

Thus, FIG. 5 shows an embodiment in which the inner mutually facing ends of the two part shafts 31, 32 are connected to one another via a predetermined weakening region 39. According to FIG. 5, the part battens 35, 36, too, are connected to one another via a predetermined weakening region 40. There is likewise a predetermined weakening region 41 between the two part reeds 37, 38. Should twisting and torsional stress on the reed, the reed batten and the reed shaft become inadmissibly high during operation, for example in the event of the failure of one of the drive trains, then the part reeds 37, 38, part battens 35, 36 and part shafts 31, 32 are separated from one another in due time. However, the destruction of even further parts of the loom is avoided.

It will be appreciated that the three predetermined weakening regions 39, 40 and 41 do not always have to be present jointly, but may also be used independently and in any desired combination.

Figure 6:
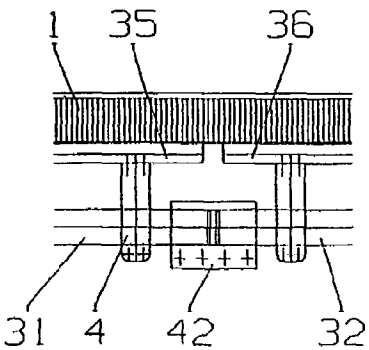
FIG. 6 shows an embodiment corresponding to FIG. 5, but further modified.

A modification of the type of construction illustrated in FIG. 5 is shown in FIG. 6. In this case, the two inner mutually facing ends of the part shafts 31, 32 which are in alignment with one another are connected to one another via a torque limitation coupling 42. In the case of an excessive torsional moment on the reed shaft, the torque limitation coupling is disengaged, with the result that damage to the part shafts 31, 32 is avoided. This also applies to the reed, because the mutual rotation of the part shafts will generally remain low. Moreover, further signal or switching devices may be linked to the disengagement of the torque limitation coupling 42, so that a rapid switch-off of the loom in an emergency is ensured.

The arrangement of a torque limitation coupling may be combined with the design possibilities already described for the reed and the reed batten. Thus, FIG. 6 shows a continuous reed 1 in conjunction with a reed batten which consists of two separate part battens.

Figure 7:
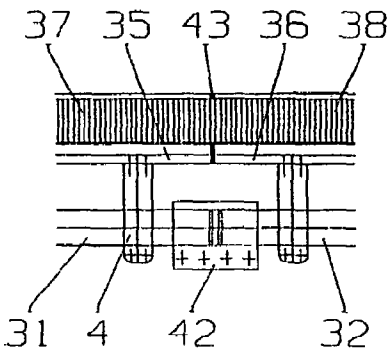
FIG. 7 contains a specific design on the principle of the torque limitation coupling.

It is indicated in FIG. 7 that a torque limitation coupling 42 with a sliding and deflection region 43 of comparable function in the region of the reed is present.

The formation of the reed shaft by two part shafts 31, 32 which are in alignment with one another is illustrated in FIG. 2 in that the mutually facing inner ends of the two part shafts stand opposite one another approximately in the geometric longitudinal center of the reed and of the entire reed shaft consisting of the two part shafts. This may also be tacitly assumed for forming the reed and the reed batten from two parts. It is, however, in no way mandatory, and not even optimal in any event, to place the "interface" between the part shafts 31, 32, the part reeds 37, 38 and the part battens 35, 36 into the geometric longitudinal center of the reed and of the reed shaft. To be precise, particularly in jet looms, parts of the weft thread insertion system must be mounted on one of the outer ends of the reed batten and be moved together with the reed. The reciprocating movement of these parts of the weft thread insertion system requires an additional drive power on one of the two drive trains and leads to an uneven load on the reed, reed batten and reed shaft. If a continuous design of these parts is assumed, there is a region in which this load is the lowest.

Figure 8:
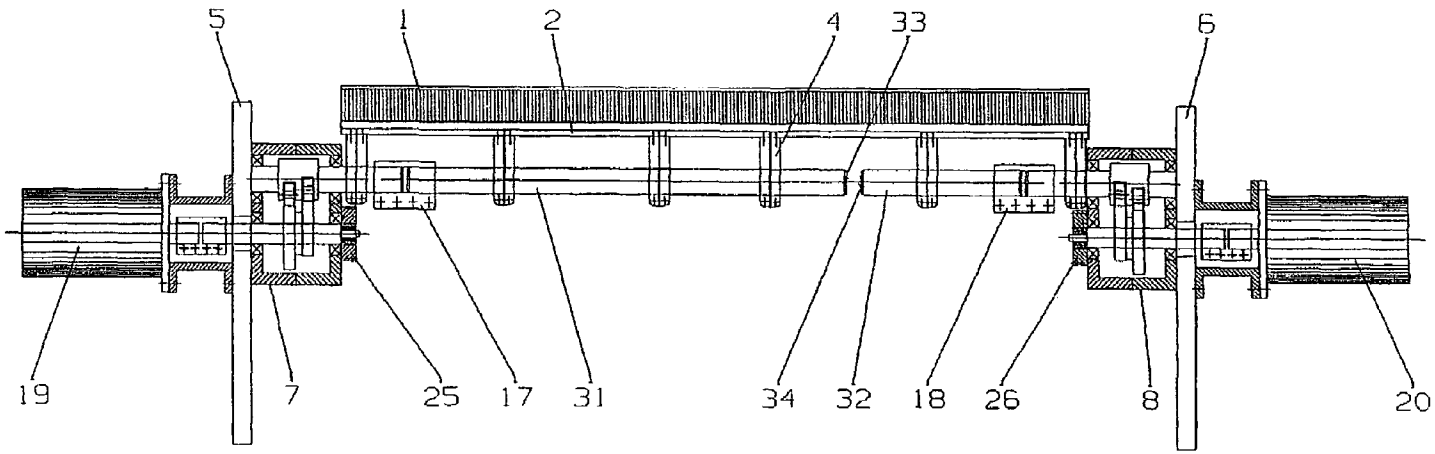
FIG. 8 illustrates modifications of the arrangement point between the two part shafts of the reed shaft.

According to a further refinement, therefore, there is selectively provision for defining said "interface", that is to say the arrangement point of the mutually facing inner ends of the part shafts 31, 32, if appropriate also of the part shafts 31, 32 and of the part battens 35, 36, according to the region of lowest transverse stress which a theoretically assumed continuous unit consisting of a reed shaft, reed and reed batten would have. In most practical instances, this would be a region which is located within a middle third of the length of the theoretically assumed continuous unit. This configuration is shown in FIG. 8. The reference numerals are the same here as in FIG. 2. This possibility of advantageously arranging the "interface" also applies, of course, when predetermined weakening points and/or a torque limitation coupling are provided.

Figure 9:
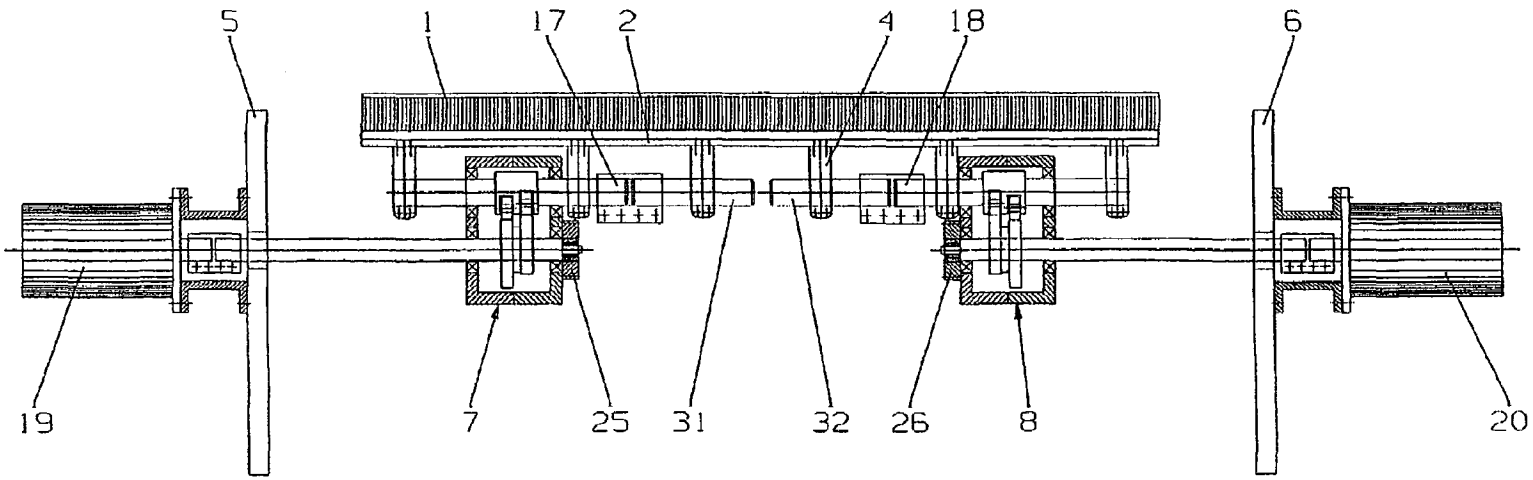
FIG. 9 shows, in comparison with FIG. 2, the shifted arrangement of the conversion gear.

FIG. 9 shows that the arrangement point of the conversion gear 7, 8 on its associated part shaft 31, 32 is shifted inward from the outer end as far as one third of the part shaft length. Here, too, the reference numerals are the same as in FIG. 2.

In terms of the substantial to complete mechanical decoupling, provided in the reed drive according to the invention, of the two drive trains, each of which comprises at least one electric motor 19, 20, one conversion gear 7, 8 and one output coupling 17, 18, but additionally also a part shaft 31, 32, the electronic synchronism regulation of the two drive trains assumes special importance. A first possibility for this is shown by the synchronism regulation, illustrated diagrammatically in FIG. 10, of the electric motors 19, 20 in a master/slave arrangement.

Figure 10:
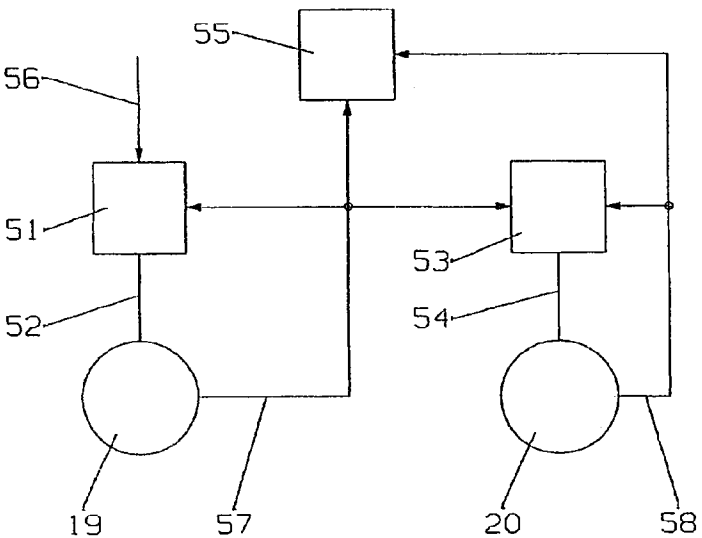
FIG. 10 shows a first diagram of an electronic synchronism regulation for the reed drive according to the invention.

Both in FIG. 10 and in FIGS. 1, 2, 8 and 9, the two electric motors are designated by 19 and 20. The first electric motor 19 is assigned a first actuator 51 which may be designed as an inverter and serves for the regulated operation of the first electric motor 19. A current carrier 52 is present for this purpose. In or on the first electric motor 19 there is a resolver which feeds an actual value of rotary position and rotational speed back to the first actuator 51. The rotary encoder 25 illustrated in FIGS. 1, 2, 8 and 9 may also serve for this purpose. In the same way, a second actuator 53, designed as an inverter, and also a current carrier 54 and a resolver or rotary encoder, not designated, are provided for the second electric motor 20. Said parts are connected to one another and to a safety and check unit 55 by means of lines in the way evident from FIG. 10.

The regulating operation of the master/slave arrangement proceeds as follows: a desired value 56 is communicated to the first actuator 51 from an external source. The desired value 56 comprises the rotary position or the rotational speed or a combination of both. The resolver of the first electric motor 19 feeds an actual value 57 back to the first actuator 51. In this case, the actual value 57 is the variable analogous to the desired value 56. On the basis of a comparison of the desired value 56 and actual value 57, the first actuator 51 regulates the rotary position and/or rotational speed of the first electric motor 19. However, the actual value 57 is also communicated additionally to the second actuator 53 as a desired value. This desired value may again comprise the rotary position or rotational speed or a combination of both. The resolver of the second electric motor 20 likewise emits an actual value 58 which is supplied to the second actuator 53.

The second actuator 53 and the second electric motor 20 thus follow, as a slave, the actual behavior of the master which in this case comprises the first actuator 51 and the first electric motor 20.

Moreover, the actual values 57 and 58 are supplied to the safety and check unit 55 which may be implemented in one of the actuators 51 or 53 as a software solution or may be an independent apparatus with its own logic.

In the safety and check unit 55, the deviation of the actual value 58 from the desired value 57 is observed. If it overshoots a predetermined limit value, protective functions are activated, such as, for example, a cutting out of one or both electric motors 19, 20.

Figure 11:
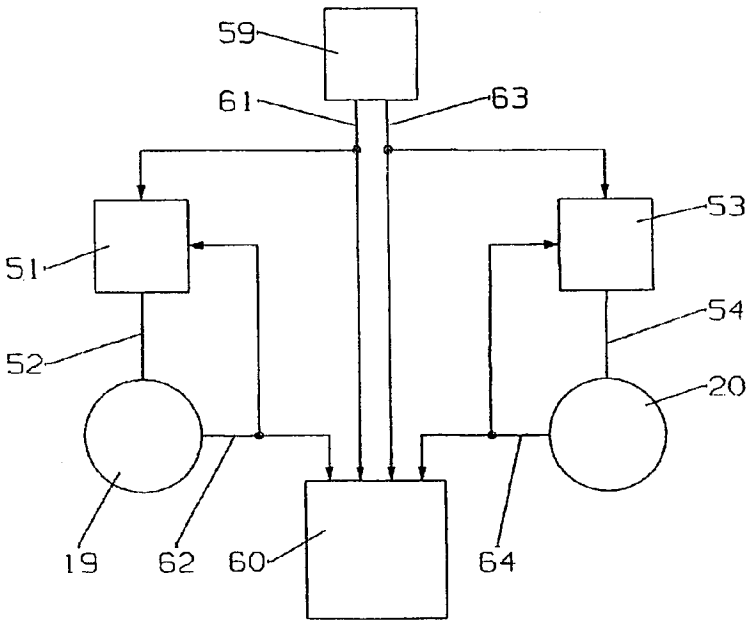
FIG. 11 reproduces the diagram of a synchronism regulation modified in comparison with FIG. 10.

Another arrangement for synchronism regulation on the master/slave principle is illustrated in FIG. 11. This synchronism regulation is constructed on the principle of the common master which, in particular, may be what is known as a virtual master, that is to say does not originate from the actual behavior of another real movement.

According to FIG. 11, the first electric motor is designated by 19 and the second by 20 according to FIGS. 1, 2, 8 and 9. As in the synchronism regulation according to FIG. 10, the first electric motor 19 is assigned a first actuator 51 with a current carrier 52 and the second electric motor 20 is assigned a second actuator 53 with a current carrier 54, specifically also with the same details and functional possibilities as was described with regard to FIG. 10. 59 designates the common master, from which first and second desired values 61 and 63 pass to the actuators 51 and 53. The safety and check unit is designated by 60 in FIG. 11 and may be implemented in the common master 59 or in one of the actuators as a software solution. It may, however, also be designed as an independent apparatus with suitable logic.

The difference in functioning from the synchronism control according to FIG. 10 is that the common master 59 sends separate desired values 61 and 63 to the first and the second actuator 51 and 53. The desired values 61 and 63 will, in general, coincide exactly. There is the basic possibility, however, of operating with desired values deviating from one another. This may be utilized, for example, up to a certain extent, in order to eliminate pronounced start-up points on one side of the fabric.

Moreover, in the synchronism regulation according to FIG. 11, the two electric motors 19 and 20 regulate themselves independently of one another on the basis of the input desired values 61 and 63. All the first and second desired values 61 and 63 input and also the first and second actual values 62 and 64 occurring are delivered to the safety and check unit 60. A check is made there as to how the actual values 64 and 62 deviate from one another. Additionally or alternatively, it is also established how the deviation of the second actual value 64 from the first actual value 62 is dependent on the deviation of the second desired value from the first desired value 61. If at least one of these observed deviations overshoots a predetermined limit value in each case, protective functions are activated, that is to say one or both electric motors 19, 20 are stopped.

Figure 12:
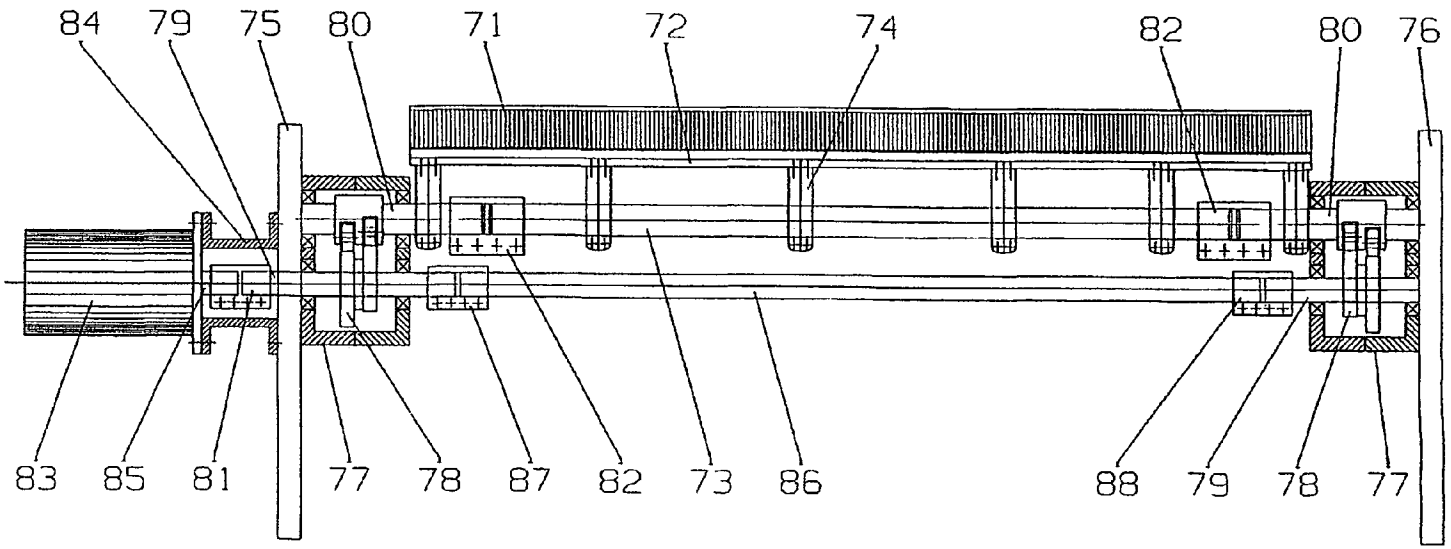
FIG. 12 illustrates a view, corresponding to FIG. 1, of a further reed drive according to the invention which differs from all the versions shown hitherto and contains another solution for achieving the object on which the invention is based.

FIG. 12 serves for explaining by further details the reed drive according to the second solution proposal of the invention which is claimed by claim 16. The illustration corresponds essentially to that according to FIGS. 1, 2, 8 and 9.

FIG. 12 again shows a continuous reed 71 with a reed batten 72 and fastening arms 74 which connect the reed 71 to the reed shaft 73. 75 and 76 indicate fixed columns of the loom, not illustrated any further. On each of the columns 75, 76 is fastened in each case a conversion gear 77, each of which contains cam disks 78 and also an input member 79 and an output member 80. via an input coupling 81, the input member 79 of the conversion gear 77 located on the column 75 is coupled fixedly in terms of rotation to the output shaft 85 of an electromotive rotary drive 83. This electromotive rotary drive, designated briefly below as an electric motor 83, is fastened via an intermediate flange 84 to the column 75, specifically to that side of the column 75 opposite the conversion gear 77.

The output member 80 of each of the conversion gears is connected fixedly in terms of rotation to the reed shaft 73 by means of an output coupling 82. The designations "input coupling" and "output coupling" are intended merely to identify the installation point. These are rigid, connecting couplings without a shift function. Only the rotationally fixed connection is essential. The input and output members 79 and 80 of the two conversion gears 77 contain simple shafts. Structural deviations, with functioning remaining unchanged, are readily possible, such as, for example, by means of hollow shafts, into which coupling plug-in journals are plugged. It is also possible to produce the output shaft 85 of the electric motor 83 in one part with the shaft of the input member 79, and likewise the shafts of the output members 80 with the reed shaft 73.

The essential function of the conversion gears has already been described with reference to FIG. 1 and also applies here. It involves solely converting the rotational movement of the input members 79 into a movement of the output members which is reversible in the direction of rotation. In connection with the described rotationally fixed coupling of the input and output members to the output shaft of the electric motor 83 or to the reed shaft 73, the function, already described with regard to FIG. 1, also applies here again for the entire drive train. What is achieved is that a movement cycle of an input member 79 corresponds to the movement of the reed 71 from one reed beat-up to the next following reed beat-up, so that the number of complete revolutions of an input member 79 is equal to the number of complete movement cycles which the reed shaft 73 executes in the same unit of time.

The particular feature of the embodiment according to FIG. 12 and therefore a difference from the embodiments described previously is the connecting shaft 86 which is arranged parallel to the reed shaft 73 between the conversion gears 77. It is coupled fixedly in terms of rotation to the input members 79 of the conversion gears 77 by the rigid connecting couplings 87 and 88. The drive torque emanating from the drive shaft 85 of the electric motor 83 is thus apportioned to two drive trains, one of which acts on the reed shaft 73 directly via the conversion gear 77 arranged on the column 75, while the other drive train is connected via the connecting shaft 88 to the conversion gear 77 which is located on the column 76 and which likewise drives the reed shaft 73 from there.

The invention claimed is:

1. A reed drive of a loom, with a reed connected to a reed shaft, with two conversion gears (7, 8) which are located respectively at two outward-facing regions of the reed shaft (3) and which each respectively have a movable input member (11, 12) and a movable output member (13, 14), wherein the output member (13, 14) of each conversion gear (7, 8) is connected fixedly in terms of rotation to a respective associated one of the outward-facing regions of the reed shaft, with a design of the conversion gears (7, 8) such that the rotational movement of the input member (11, 12) is converted into a reversible rotational movement of the output member (13, 14) of each respective one of the conversion gears, such that the number of complete revolutions of the input member per unit of time is equal to the number of complete movement cycles of the output member per said unit of time, and with two electromotive rotary drives (19, 20) respectively having two output shafts (23, 24) that are each respectively connected with a respective one of the input members for rotation in common with and at the same rotational speed as the respective input member (11, 12).

2. The reed drive as claimed in claim 1, in which the reed shaft (3) consists of two part shafts (31, 32) which are in alignment with one another and which have mutually facing inner ends thereof facing one another.

3. The reed drive as claimed in claim 2, wherein the reed is continuous over the entire weaving width and is connected to a reed batten consisting of two part battens (35, 36) which are in alignment with one another and are structurally separate from one another and each of which is connected to one of the part shafts (31, 32)

4. The reed drive as claimed in claim 2, in which the reed is formed from two structurally separate part reeds (37, 38) which lie in a common plane and each of which is connected to one of the part shafts (31, 32).

5. The reed drive as claimed in claim 2, in which the mutually facing inner ends of the two part shafts (31, 32) stand opposite one another with the possibility of mutual rotatability.

6. The reed drive as claimed in claim 5, in which the mutually facing inner ends engage positively and rotatably one in the other.

7. The reed drive as claimed in claim 5, in which the mutually facing inner ends of the part shafts (31, 32) are connected to one another via a torque limitation coupling (42).

8. The reed drive as claimed in claim 2, in which the mutually facing inner ends of the part shafts (31, 32) stand opposite one another in the geometric longitudinal center of the entire reed shaft consisting of the two part shafts (31, 32).

9. The reed drive as claimed in claim 2, in which the arrangement point of the mutually facing inner ends of the part shafts (31, 32) is defined according to the region of lowest torsional and/or transverse stress of a theoretically assumed continuous unit consisting of a reed shaft, reed and reed batten.

10. The reed drive as claimed in claim 9, in which the arrangement point of the mutually facing inner ends of the part shafts (31, 32) is located within a middle third of the length of the theoretically assumed continuous unit.

11. The reed drive as claimed in claim 2, in which the arrangement point of a respective one of the conversion gears (7, 8) on the respective part shaft (31, 32) is shifted inward from an outer end thereof as far as one third of a length of the part shaft.

12. The reed drive as claimed in claim 1, with an electronic synchronism regulation of the electromotive rotary drives (19, 20) in a master/slave arrangement.

13. The reed drive as claimed in claim 12, wherein the master/slave arrangement has a common master which is designed as a virtual master.

14. A reed and drive arrangement of a loom comprising:

a reed mounted on a rotationally reciprocatable reed shaft;

an electric first drive motor having a rotatable first output shaft;

an electric second drive motor having a rotatable second output shaft;

a first conversion gear arrangement having a rotatable first input member and a rotationally reciprocatable first output member, wherein said first conversion gear arrangement is adapted to convert a rotating motion of said first input member to a rotational reciprocating motion of said first output member, and said first input member is connected for same-speed rotation with said first output shaft, and said first output member is connected for same-speed rotational reciprocation with a first outer end portion of said reed shaft; and a second conversion gear arrangement having a rotatable second input member and a rotationally reciprocatable second output member, wherein said second conversion gear arrangement is adapted to convert a rotating motion of said second input member to a rotational reciprocating motion of said second output member, and said second input member is connected for same-speed rotation with said second output shaft, and said second output member is connected for same-speed rotational reciprocation with a second outer end portion of said reed shaft; and wherein said reed and drive arrangement includes no step-up gear and no step-down gear between said drive motors and said reed shaft, so that the number of complete rotations of said output shafts per unit of time is equal to the number of complete reciprocation movement cycles of said reed shaft per said unit of time.

15. The reed and drive arrangement according to claim 14, wherein said first and second drive motors are respectively arranged laterally outside and beyond a width of said reed.

16. The reed and drive arrangement according to claim 15, wherein said first and second conversion gear arrangements are respectively arranged laterally outside and beyond a width of said reed.

17. The reed and drive arrangement according to claim 15, wherein said first and second conversion gear arrangements are respectively arranged laterally within a width of said reed.

18. The reed and drive arrangement according to claim 14, wherein said first output shaft and said first input member are aligned and connected axially with one another, said first output member and said first outer end portion of said reed shaft are aligned and connected axially with one another, said second output shaft and said second input member are aligned and connected axially with one another, and said second output member and said second outer end portion of said reed shaft are aligned and connected axially with one another.

19. The reed and drive arrangement according to claim 14, wherein said reed shaft is a discontinuous reed shaft that includes two axially aligned part shafts.

20. The reed and drive arrangement according to claim 19, wherein said reed is continuous over an entire weaving width, and further comprising a discontinuous reed batten that includes two axially aligned and structurally separate part battens that are each respectively connected to a respective one of said part shafts, and wherein said reed is connected to said two part battens by which said reed is mounted on said part shafts of said reed shaft.

21. The reed and drive arrangement according to claim 19, wherein said reed comprises two structurally separate part reeds that lie in a common plane and that are each respectively mounted on a respective one of said part shafts.

22. The reed and drive arrangement according to claim 19, wherein said two part shafts respectively have two inner ends thereof facing one another and not connected to one another.

23. The reed and drive arrangement according to claim 19, further comprising a torque-limiting coupling, and wherein said two part shafts respectively have two inner ends thereof facing one another and coupled to one another by said torque-limiting coupling.

* * * * *